US011638843B2

(12) United States Patent
Jones et al.

(10) Patent No.: US 11,638,843 B2
(45) Date of Patent: May 2, 2023

(54) CASE OR CRADLE FOR A FALL ARREST DEVICE

(71) Applicant: Latchways Plc, Devizes (GB)

(72) Inventors: Owain Jones, Devizes (GB); Karl Jones, Devizes (GB); Jacob Thackeray Squire, Devizes (GB)

(73) Assignee: Latchways Plc, Devizes (GB)

( * ) Notice: Subject to any disclaimer, the term of this patent is extended or adjusted under 35 U.S.C. 154(b) by 481 days.

(21) Appl. No.: 16/639,904

(22) PCT Filed: Jul. 31, 2018

(86) PCT No.: PCT/GB2018/052177

§ 371 (c)(1),
(2) Date: Feb. 18, 2020

(87) PCT Pub. No.: WO2019/038513

PCT Pub. Date: Feb. 28, 2019

(65) Prior Publication Data

US 2020/0360740 A1 Nov. 19, 2020

(30) Foreign Application Priority Data

Aug. 24, 2017 (GB) ..... 1713641

(51) Int. Cl.
*A62B 35/00* (2006.01)
*E04G 21/32* (2006.01)

(52) U.S. Cl.
CPC ..... *A62B 35/0093* (2013.01); *A62B 35/0068* (2013.01); *A62B 35/0075* (2013.01); *E04G 21/3204* (2013.01); *E04G 21/3276* (2013.01)

(58) Field of Classification Search
CPC ..... A62B 35/0093; A62B 35/0068; A62B 35/0075; E04G 21/3204; E04G 21/3276
See application file for complete search history.

(56) References Cited

U.S. PATENT DOCUMENTS

| | | | | |
|---|---|---|---|---|
| 2,546,202 | A | 3/1951 | Trouin | |
| 4,942,943 | A | 7/1990 | Flaherty | |
| 5,730,407 | A | 3/1998 | Ostrobrod | |
| 9,601,913 | B2 * | 3/2017 | Killen | B65H 49/32 |
| 9,843,852 | B2 * | 12/2017 | Mcgovern, Jr. | F16F 7/14 |
| 10,247,520 | B2 * | 4/2019 | Manly | F41C 27/18 |
| 2009/0178887 | A1 * | 7/2009 | Reeves | A62B 1/10 182/239 |
| 2012/0145481 | A1 | 6/2012 | Jones | |
| 2013/0177350 | A1 * | 7/2013 | Guihard | F16B 7/20 403/322.1 |

(Continued)

FOREIGN PATENT DOCUMENTS

| | | | |
|---|---|---|---|
| CN | 206463375 | U | 9/2017 |
| GB | 2306107 | A | 4/1997 |

(Continued)

*Primary Examiner* — Eret C McNichols
(74) *Attorney, Agent, or Firm* — Jones Day

(57) ABSTRACT

A case or support cradle (10) for a fall arrest device has a shape or configuration enabling rolling of the case or cradle (10) along an arcuate path. The rollable case or cradle (10) allows the fall arrest device received therein to smoothly follow a user's movements around a work site, thereby protecting the device from damage due to dragging or scraping along a floor surface.

9 Claims, 4 Drawing Sheets

(56) References Cited

U.S. PATENT DOCUMENTS

2018/0178044 A1* 6/2018 Hetrich ..... A62B 1/08

FOREIGN PATENT DOCUMENTS

| | | | | |
|---|---|---|---|---|
| JP | 3166529 | U | 3/2011 | |
| KR | 20000018193 | A | 4/2000 | |
| WO | 2010094921 | A1 | 8/2010 | |
| WO | WO-2021010847 | A1 * | 1/2021 | ..... A62B 35/0093 |

* cited by examiner

CASE OR CRADLE FOR A FALL ARREST DEVICE

CROSS REFERENCE TO RELATED APPLICATIONS

This application is the United States national phase of International Application No. PCT/GB2018/052177 filed Jul. 31, 2018, and claims priority to United Kingdon Application No. 1713641.7 filed Aug. 24, 2017, the disclosures of which are hereby incorporated by reference in their entirety.

BACKGROUND

Technical Field

The present disclosure relates to a case or cradle for a fall arrest device. In particular, the present disclosure provides a rollable case or cradle for use with a self-retracting lifeline device, as well as self-retracting lifeline systems having such a case or cradle.

Description of the Related Art

Fall arrest systems and devices, e.g., self-retracting lanyards and harnesses, are used to prevent personnel working at heights from suffering injury as a result of falling or other such events. Fall arrest systems are often referred to as height safety systems or fall protection systems. In some arrangements, such devices include a so called safety block arranged to be suspended overhead from an anchor structure. Such arrangements typically include: a drum upon which a safety line or lifeline is wound; a speed responsive mechanism arranged to inhibit the drum rotation above a predetermined rotational speed; and an energy absorber device arranged to be activated if a load above a predetermined threshold is deployed when the speed responsive mechanism is deployed.

A self-retracting lifeline (SRL) is a type of fall arrest device which includes a rewinding mechanism configured to automatically pay out and retract the lifeline as necessary to allow the user's movement whilst keeping the lifeline taut. The drum upon which the lifeline is wound is therefore biased to rewind the lifeline onto the drum. Many different types of SRLs exist, each adapted to be suitable for a specific range of uses. A leading edge SRL is designed to be used where a fall potential exists over a sharp edge. A sharp edge is defined as any edge that comes into contact with the lifeline and in the event of a fall, has the potential to cut the lifeline. For example, a construction worker on a rooftop may wear a leading edge SRL to prevent accidents caused by falling off the roof.

Fall arrest devices are generally either connected to an anchor point proximate foot (or surface) level, or suspended from an anchor point above head height. In some situations, the device has to be anchored at foot level for safety reasons (for example when working on a flat roof or the like). If the fall arrest device is anchored at floor level, the device can be dragged around on the floor (or other surface it is supported on) as the user moves around the site. This can damage the fall arrest device and the important safety labels attached to the outside of the device. If the case and/or safety information is compromised, then the device must be replaced. This is costly and inconvenient.

Within the prior art, U.S. Pat. No. 5,730,407 discloses a roof anchor system that uses a support for a safety line device in which the support travels on casters and the support is directly anchored to a roof structural anchor.

There is a need in the art for an improved device configured for protecting the fall arrest device from damage that may occur if the fall arrest device is dragged on the ground during use.

SUMMARY

Accordingly and generally, provided is an improved rollable case or cradle for use with a self-retracting lifeline device, as well as self-retracting lifeline systems having such a case or cradle. Preferably, provided is an improved rollable case or cradle for use with a self-retracting lifeline device that protects the fall arrest device from damage that may occur if the self-retracting lifeline device is dragged on the ground during use.

According to some non-limiting embodiments or aspects, a case or support cradle for a fall arrest device may have a shape or configuration enabling rolling of the case or cradle along an arcuate path.

In some non-limiting embodiments or aspects, the case or cradle of the present disclosure can be used with any fall arrest device that may be anchored at floor level, such as a self-retracting lifeline device (SRL). The rollable case or cradle allows the device to smoothly follow a user's movements around a work site and thereby protects the device from damage, as the device is no longer dragging or scraping along the surface (e.g., the floor). This also protects the safety labels on the device.

In some non-limiting embodiments or aspects, the case or cradle may have a shape or configuration that directs rolling of the case or cradle along an arcuate path of a specific radius. The specific radius of the arcuate path may be defined by the shape or configuration of the case or cradle. The case or cradle shape or configuration may inhibit rolling of the case or cradle other than along an arcuate path.

In some non-limiting embodiments or aspects, the cradle may have first and second apertures to respectively allow access to a connection point attached to the fall arrest device (e.g. for receiving a shackle, carabiner or other connector) and to allow a lifeline (or lanyard etc.) to extend therethrough. In use, as the case or cradle rolls, the fall arrest device may rotate about an axis (e.g., the rolling axis). The axis about which the fall arrest device rotates may be orientated in the same direction as the safety line of the device extending to the user connected to the safety line. This may help ensure that the safety line (or lifeline) does not get tangled when the device rotates or rolls, which would impede its function.

In some non-limiting embodiments or aspects, the case or cradle may have one or more rolling contact surfaces arranged to contact a surface on which the case or cradle rests in order to effect rolling. The case or cradle may have at least one contact surface ring configured to encompass the fall arrest device, the contact surface ring arranged to contact a surface on which the case or cradle rests in order to effect rolling. The contact surface ring may be toroidal in shape (e.g., have a circular cross section). In some non-limiting embodiments or aspects, the case or cradle may have a first contact surface ring; a second contact surface ring, and at least one link connecting the first ring to the second ring. The second ring member may have a larger diameter than the first ring member. This may be particularly advantageous for ensuring that, in use, the case or cradle rolls smoothly along an arcuate path about a fixed anchor point.

In some non-limiting embodiments or aspects, one or more of the at least one contact surface rings may be configured such that, in use, the body of the fall arrest device received therein cannot contact the surface along which the case or cradle rolls. The case or cradle may form a frame into which the fall arrest device may be received. The case may have a fall arrest device housing. Thus, the case may be retro-fitted to receive a fall arrest device therein, wherein the fall arrest device already has a housing. Alternatively, the case may form the housing for a fall arrest device specifically manufactured to be contained within the case.

In some non-limiting embodiments or aspects, at least a portion of the fall arrest device housing may be rounded, or part spherical and the housing is configured to roll on the rounded/spherical part. The housing may have a curved, cylindrical or conical portion. For example, the housing may be at least partially conically or frustoconically shaped.

In some non-limiting embodiments or aspects, at least a portion of the rolling contact surface of the case or cradle may have a shock-absorbing material. Non-limiting examples of suitable shock-absorbing materials are: resilient plastic; or resilient foam; or synthetic rubber. This shock-absorbing material may help to further protect the device from damage during use.

In some non-limiting embodiments or aspects, the rolling contact surface of the case or cradle may include a ring having a plurality of protrusions and/or indentations to improve traction between the case or cradle and the surface on which the case or cradle rests.

In some non-limiting embodiments or aspects, at least one tire may be received on the housing to define a rolling surface. Tires may be conventionally made of rubber, synthetic rubber or plastic and often have patterns of protrusions and/or indentations on the outer surface.

In some non-limiting embodiments or aspects, the case or cradle may be configured to roll about a rolling axis. The rolling axis may be inclined upwardly with respect to the surface on which the case or cradle rests.

In some non-limiting embodiments or aspects, the case or cradle may have one or more engagement formations configured to secure the case or cradle to the fall arrest device. The one or more engagement formations may have one or more fixing apertures, each configured to receive a mechanical fastener therethrough. An example of a mechanical fastener may be a bolt. In other non-limiting embodiments or aspects, the case or cradle may be configured to be glued, welded or otherwise secured to the fall arrest device.

In some non-limiting embodiments or aspects, a cradle or case may be provided in combination with a fall arrest device arranged to be received in the case or cradle. The fall arrest device may be a SRL. The fall arrest device may be a leading edge SRL.

In some non-limiting embodiments or aspects, the case or cradle may have an aperture configured to receive the lifeline of the fall arrest device therethrough. The fall arrest device and the case or cradle may have complementary engagement formations arranged to secure the device to the case or cradle.

In some non-limiting embodiments or aspects, the apparatus may further have one or more mechanical fixings configured to be received in one or more fixing apertures in the cradle or case.

In some non-limiting embodiments or aspects, a fall protection apparatus may have: i) a SRL comprising: a rotatable drum for winding a lifeline; a connector to connect the SRL to a structural anchor; and ii) a cradle according to any embodiment of the first aspect of the disclosure for cradling the SRL. The cradle may be secured to the SRL by one or more mechanical fixings.

In some non-limiting embodiments or aspects, the cradle may not be directly connected to the structural anchor. The structural anchor may be connected to the SRL by means of the connector extending via an opening in the cradle. The connector may be a shackle or a carabiner.

In some non-limiting embodiments or aspects, the rolling axis of the cradle may be transverse to the rotational axis of the drum of the SRL.

In some non-limiting embodiments or aspects, the SRL may have a device housing with a snap-fit engagement between the device housing and the cradle. For example, the cradle and the device housing may each have complementary engaging formations.

In some non-limiting embodiments or aspects, the fall arrest device may also include one or more of: a lifeline; an energy absorber device configured to be attached to the lifeline; a harness for attaching the energy absorber relative to a user; one or more connectors for connecting the SRL to an anchor point and/or for connecting the lifeline relative to a user.

In some non-limiting embodiments or aspects, the lifeline may be in the form of a cable, a line, a filament, a strap, webbing, lanyard, belt, or any other product or material that can be used as a safety lifeline.

In some non-limiting embodiments or aspects, a cradle for a fall arrest device may have a first contact surface ring defining a first aperture and having a first diameter; a second contact surface ring defining a second aperture and having a second diameter different than the first diameter; and one or more links connecting the first contact surface ring to the second contact surface ring. The cradle may be configured to roll around an arcuate path about a rolling axis extending through the first opening and the second opening.

In some non-limiting embodiments or aspects, the rolling axis may be inclined at an angle relative to a surface supporting the cradle. The arcuate path may have a specific radius determined by the first diameter and the second diameter.

In some non-limiting embodiments or aspects, one or more engagement formations may be formed on at least one of the first contact surface ring and the second contact surface ring, each of the one or more engagement formations configured for connecting to complementary engagement formations on a fall arrest device. At least one of the one or more engagement formations may be configured for snap-fit engagement with the fall arrest device. At least one of the one or more engagement formations may be a fixing aperture configured to receive a mechanical fastener for securing the cradle relative to the fall arrest device.

In some non-limiting embodiments or aspects, the cradle may have the fall arrest device. The fall arrest device may be a self-retracting lanyard. The fall arrest device may rotate about the rolling axis with the cradle. The rolling axis may be orientated in a same direction as a safety line of the fall arrest device.

In some non-limiting embodiments or aspects, a case for a fall arrest device may have a housing having a first end, a second end, and a body having a circular cross section over at least a portion of a body length extending between the first end and the second end. The body may have one or more rolling contact surfaces. The body may be configured to roll on the one or more rolling contact surfaces in an arcuate path about a rolling axis.

In some non-limiting embodiments or aspects, the first end may have a connection point configured for receiving a connector for connecting the housing to an anchor. The second end may have an aperture configured for receiving a lifeline. The housing may have a first half connected to the second half.

In some non-limiting embodiments or aspects, the housing may have the fall arrest device. The fall arrest device may be a self-retracting lanyard. The fall arrest device may rotate about the rolling axis with the housing.

In some non-limiting embodiments or aspects, at least a portion of one or more rolling contact surfaces may have a shock-absorbing material. The shock-absorbing material may be a tire at a largest diameter of the housing. The tire may have one or more projections or indentations on its surface for improving a grip with a contact surface. At least a portion of one or more rolling contact surfaces may have a ring having one or more protrusions or indentations for improving a grip with a contact surface.

In some non-limiting embodiments or aspects, a cradle for a fall arrest device may have a first contact surface ring defining a first aperture and having a first diameter a second contact surface ring defining a second aperture and having a second diameter different than the first diameter; and one or more links connecting the first contact surface ring to the second contact surface ring. The cradle may be configured to roll around an arcuate path about a rolling axis extending through the first opening and the second opening.

In some non-limiting embodiments or aspects, the rolling axis may be inclined at an angle relative to a surface supporting the cradle. The arcuate path may have a specific radius determined by the first diameter and the second diameter.

In some non-limiting embodiments or aspects, one or more engagement formations may be formed on at least one of the first contact surface ring and the second contact surface ring, each of the one or more engagement formations configured for connecting to complementary engagement formations on a fall arrest device. At least one of the one or more engagement formations may be configured for snap-fit engagement with the fall arrest device. At least one of the one or more engagement formations may be a fixing aperture configured to receive a mechanical fastener for securing the cradle relative to the fall arrest device.

In some non-limiting embodiments or aspects, the cradle may have the fall arrest device. The fall arrest device may be a self-retracting lanyard. The fall arrest device may rotate about the rolling axis with the cradle. The rolling axis may be orientated in a same direction as a safety line of the fall arrest device.

In some non-limiting embodiments or aspects, the fall arrest device may have a connector for connecting the fall arrest device to an anchor. The fall arrest device may be received in a space between the first aperture and the second aperture. The fall arrest device may be connected to at least one of the first contact surface ring and the second contact surface ring by one or more mechanical fasteners. The fall arrest device may be connected to at least one of the first contact surface ring and the second contact surface ring by a snap-fit arrangement. The fall arrest device may have one or more engagement formations configured for connecting with corresponding one or more engagement formations on at least one of the first contact surface ring and the second contact surface ring.

Further non-limiting embodiments or aspects will now be described in the following numbered clauses.

Clause 1: A case or support cradle for a fall arrest device, the case or support cradle having a shape or configuration enabling rolling of the case or cradle along an arcuate path.

Clause 2: The case or cradle according to clause 1, the case or cradle having a shape or configuration that directs rolling of the case or cradle along an arcuate path of a specific radius.

Clause 3: The case or cradle according to clause 1 or clause 2, wherein the specific radius of the arcuate path is defined by the shape or configuration of the case or cradle.

Clause 4: The case or cradle according to any of clauses 1-3, wherein the case or cradle shape or configuration inhibits rolling of the case or cradle other than along an arcuate path.

Clause 5: The case or cradle according to any of clauses 1-4, wherein in use, as the case or cradle rolls, the fall arrest device rotates about an axis.

Clause 6: The case or cradle according to any of clauses 1-6, wherein the axis about which the fall arrest device rotates is orientated in the same direction as the safety line of the device extending to the user connected to the safety line.

Clause 7: The case or cradle according to any of clauses 1-6, wherein the case or cradle has one or more rolling contact surfaces arranged to contact a surface on which the case or cradle rests in order to effect rolling.

Clause 8: The case or cradle according to any of clauses 1-7, wherein the case or cradle comprises at least one contact surface ring configured to encompass the fall arrest device, the contact surface ring arranged to contact a surface on which the case or cradle rests in order to effect rolling.

Clause 9: The case or cradle according to any of clauses 1-8, comprising: a first contact surface ring; a second contact surface ring; and at least one link connecting the first ring to the second ring.

Clause 10: The case or cradle according to any of clauses 1-9, wherein the second ring member has a larger diameter than the first ring member.

Clause 11: The case according to any of clauses 1-10, wherein the case comprises a fall arrest device housing.

Clause 12: The case according to any of clauses 1-11, wherein at least a portion of the housing is rounded, or part spherical and the housing rolls on the rounded/spherical part.

Clause 13: The case according to any of clauses 1-12, wherein the housing comprises a cylindrical or conical portion.

Clause 14: The case according to any of clauses 1-13, wherein the housing is conically or frustoconically shaped.

Clause 15: The case or cradle according to any of clauses 1-14, wherein at least a portion of the rolling surface of the case or cradle comprises a shock-absorbing material.

Clause 16: The case or cradle according to any of clauses 1-15, wherein the rolling contact surface of the case or cradle includes a ring comprising a plurality of protrusions and/or indentations to improve traction between the case or cradle and the surface on which the case or cradle rests.

Clause 17: The case or cradle according to any of clauses 1-16, wherein at least one tire is received on the housing to define a rolling surface.

Clause 18: The case or cradle according to any of clauses 1-17, wherein the case or cradle is configured to roll about a rolling axis, wherein the rolling axis is inclined upwardly with respect to the surface on which the case or cradle rests.

Clause 19: The case or cradle according to any of clauses 1-18, further comprising one or more engagement formations configured to secure the case or cradle to the fall arrest device.

Clause 20: The case or cradle according to any of clauses 1-19, wherein the one or more engagement formations comprise one or more fixing apertures, each configured to receive a mechanical fastener therethrough.

Clause 21: An apparatus comprising a cradle or case according to any preceding claim in combination with a fall arrest device arranged to be received in the case or cradle.

Clause 22: The apparatus according to clause 21, wherein the fall arrest device is a self-retracting lifeline device.

Clause 23: The apparatus according to clause 21 or clause 22, wherein the case or cradle comprises an aperture configured to receive the lifeline therethrough.

Clause 24: The apparatus according to any of clauses 21-23 as they depend on clause 19, wherein the fall arrest device comprises complementary engagement formations arranged to be connected to the engagement formations on the cradle or case.

Clause 25: The apparatus according to any of clauses 21-24 as they depend on clause 20, further comprising one or more mechanical fasteners configured to be received in the one or more fixing apertures in the cradle or case.

Clause 26: A fall protection apparatus comprising: (i) a self-retracting lifeline (SRL) device comprising: a rotatable drum for winding a lifeline; a connector to connect the SRL to a structural anchor; (ii) a cradle according to any preceding claim for cradling the SRL.

Clause 27: The fall protection apparatus according to clause 26, wherein the cradle is secured to the SRL by one or more mechanical fixings.

Clause 28: The fall protection apparatus according to clause 26 or clause 27, wherein the cradle is not directly connected to the structural anchor.

Clause 29: The fall protection apparatus according to any clauses 26-28, wherein the structural anchor is connected to the SRL by means of the connector extending via an opening in the cradle.

Clause 30: The fall protection apparatus according to any clauses 26-29, wherein the rolling axis of the cradle is transverse to the rotational axis of the drum of the SRL.

Clause 31: The fall protection apparatus according to any clauses 26-30, wherein the SRL comprises a device housing and there is a snap-fit engagement between the device housing and the cradle.

Clause 32: The fall protection apparatus according to any clauses 26-31, wherein the cradle and the device housing each comprise complementary engaging formations.

Clause 33: A cradle for a fall arrest device, the cradle comprising: a first contact surface ring defining a first aperture and having a first diameter; a second contact surface ring defining a second aperture and having a second diameter different than the first diameter; and one or more links connecting the first contact surface ring to the second contact surface ring, wherein the cradle is configured to roll around an arcuate path about a rolling axis extending through the first opening and the second opening.

Clause 34: The cradle of clause 33, wherein the rolling axis is inclined at an angle relative to a surface supporting the cradle.

Clause 35: The cradle of clause 33 or clause 34, wherein the arcuate path has a specific radius determined by the first diameter and the second diameter.

Clause 36: The cradle of any of clauses 33-35, further comprising one or more engagement formations on at least one of the first contact surface ring and the second contact surface ring, each of the one or more engagement formations configured for connecting to complementary engagement formations on a fall arrest device.

Clause 37: The cradle of any of clauses 33-36, wherein at least one of the one or more engagement formations is configured for snap-fit engagement with the fall arrest device.

Clause 38: The cradle of any of clauses 33-37, wherein at least one of the one or more engagement formations is a fixing aperture configured to receive a mechanical fastener for securing the cradle relative to the fall arrest device.

Clause 39: The cradle of any of clauses 33-38, wherein the cradle comprises the fall arrest device.

Clause 40: The cradle of any of clauses 33-39, wherein the fall arrest device is a self-retracting lanyard.

Clause 41: The cradle of any of clauses 33-40, wherein the fall arrest device rotates about the rolling axis with the cradle.

Clause 42: The cradle of any of clauses 33-41, wherein the rolling axis is orientated in a same direction as a safety line of the fall arrest device.

Clause 43: A case for a fall arrest device, the case comprising: a housing having a first end, a second end, and a body having a circular cross section over at least a portion of a body length extending between the first end and the second end; wherein the body has one or more rolling contact surfaces; and wherein the body is configured to roll on the one or more rolling contact surfaces in an arcuate path about a rolling axis.

Clause 44: The case of clause 43, wherein the first end comprises a connection point configured for receiving a connector for connecting the housing to an anchor.

Clause 45: The case of clause 43 or clause 44, wherein the second end comprises an aperture configured for receiving a lifeline.

Clause 46: The case of any of clauses 43-45, wherein the housing comprises a first half connected to the second half.

Clause 47: The case of any of clauses 43-46, wherein the housing comprises the fall arrest device.

Clause 48: The case of any of clauses 43-47, wherein the fall arrest device is a self-retracting lanyard.

Clause 49: The case of any of clauses 43-48, wherein the fall arrest device rotates about the rolling axis with the housing.

Clause 50: The case of any of clauses 43-49, wherein at least a portion of one or more rolling contact surfaces comprises a shock-absorbing material.

Clause 51: The case of any of clauses 43-50, wherein the shock-absorbing material is a tire at a largest diameter of the housing, and wherein the tire has one or more projections or indentations on its surface for improving a grip with a contact surface.

Clause 52: The case of any of clauses 43-51, wherein at least a portion of the one or more rolling contact surfaces comprises a ring having one or more protrusions or indentations for improving a grip with a contact surface.

Clause 53: A cradle for a fall arrest device, the cradle comprising: a first contact surface ring defining a first aperture and having a first diameter; a second contact surface ring defining a second aperture and having a second diameter different than the first diameter; and one or more links connecting the first contact surface ring to the second contact surface ring, wherein the cradle is configured to roll around an arcuate path about a rolling axis extending through the first opening and the second opening.

Clause 54: The cradle of clause 53, wherein the rolling axis is inclined at an angle relative to a surface supporting the cradle.

Clause 55: The cradle of clause 53 or clause 54, wherein the arcuate path has a specific radius determined by the first diameter and the second diameter.

Clause 56: The cradle of any of clauses 53-55, further comprising one or more engagement formations on at least one of the first contact surface ring and the second contact surface ring, each of the one or more engagement formations configured for connecting to complementary engagement formations on a fall arrest device.

Clause 57: The cradle of any of clauses 53-56, wherein at least one of the one or more engagement formations is configured for snap-fit engagement with the fall arrest device.

Clause 58: The cradle of any of clauses 53-57, wherein at least one of the one or more engagement formations is a fixing aperture configured to receive a mechanical fastener for securing the cradle relative to the fall arrest device.

Clause 59: The cradle of any of clauses 53-58, wherein the cradle comprises the fall arrest device.

Clause 60: The cradle of any of clauses 53-59, wherein the fall arrest device is a self-retracting lanyard.

Clause 61: The cradle of any of clauses 53-60, wherein the fall arrest device rotates about the rolling axis with the cradle.

Clause 62: The cradle of any of clauses 53-61, wherein the rolling axis is orientated in a same direction as a safety line of the fall arrest device.

Clause 63: The cradle of any of clauses 53-62, wherein the fall arrest device comprises a connector for connecting the fall arrest device to an anchor.

Clause 64: The cradle of any of clauses 53-63, wherein the fall arrest device is received in a space between the first aperture and the second aperture.

Clause 65: The cradle of any of clauses 53-64, wherein the fall arrest device is connected to at least one of the first contact surface ring and the second contact surface ring by one or more mechanical fasteners.

Clause 66: The cradle of any of clauses 59-65, wherein the fall arrest device is connected to at least one of the first contact surface ring and the second contact surface ring by a snap-fit arrangement.

Clause 67: The cradle of any of clauses 59-66, wherein the fall arrest device has one or more engagement formations configured for connecting with one or more corresponding engagement formations on at least one of the first contact surface ring and the second contact surface ring.

These and other features and characteristics of the present disclosure, as well as the methods of operation and functions of the related elements of structures and the combination of parts and economies of manufacture, will become more apparent upon consideration of the following description and the appended claims with reference to the accompanying drawings, all of which form a part of this specification, wherein like reference numerals designate corresponding parts in the various drawings. It is to be expressly understood, however, that the drawings are for the purpose of illustration and description only and are not intended as a definition of the limits of the disclosure.

BRIEF DESCRIPTION OF THE DRAWINGS

In FIGS. 1-7, like characters refer to the same components and elements, as the case may be, unless otherwise stated.

DETAILED DESCRIPTION

Figure 1:
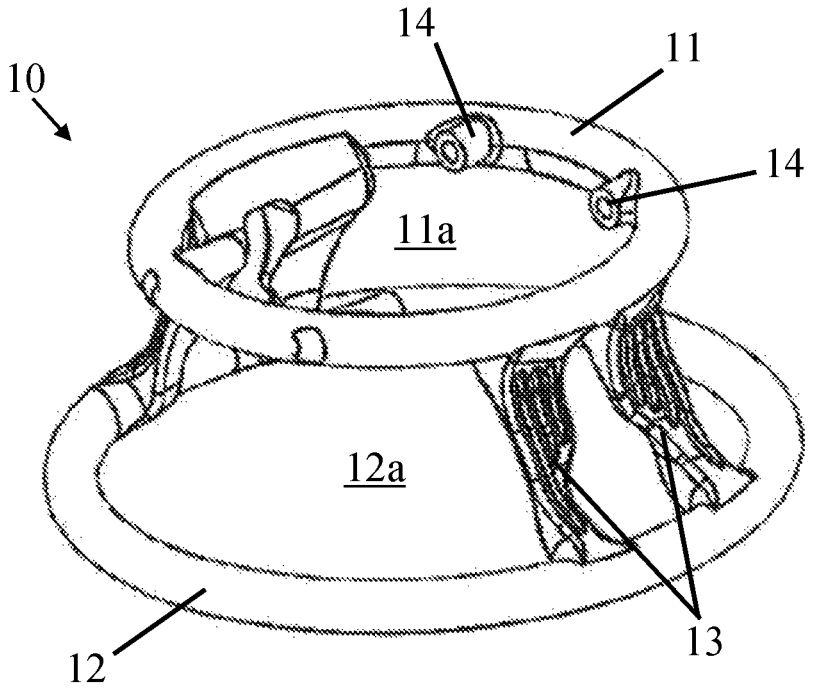
FIG. 1 is a perspective view of a rollable cradle according to the principles of the present disclosure.

As used herein, the singular form of "a", "an", and "the" include plural referents unless the context clearly dictates otherwise.

Spatial or directional terms, such as "left", "right", "inner", "outer", "above", "below", and the like, relate to the disclosure as shown in the drawing figures and are not to be considered as limiting as the disclosure can assume various alternative orientations.

All numbers and ranges used in the specification and claims are to be understood as being modified in all instances by the term "about". By "about" is meant plus or minus twenty-five percent of the stated value, such as plus or minus ten percent of the stated value. However, this should not be considered as limiting to any analysis of the values under the doctrine of equivalents.

Unless otherwise indicated, all ranges or ratios disclosed herein are to be understood to encompass the beginning and ending values and any and all subranges or subratios subsumed therein. For example, a stated range or ratio of "1 to 10" should be considered to include any and all subranges or subratios between (and inclusive of) the minimum value of 1 and the maximum value of 10; that is, all subranges or subratios beginning with a minimum value of 1 or more and ending with a maximum value of 10 or less. The ranges and/or ratios disclosed herein represent the average values over the specified range and/or ratio.

The terms "first", "second", and the like are not intended to refer to any particular order or chronology, but refer to different conditions, properties, or elements.

The term "at least" is synonymous with "greater than or equal to".

The term "not greater than" is synonymous with "less than or equal to".

As used herein, "at least one of" is synonymous with "one or more of". For example, the phrase "at least one of A, B, and C" means any one of A, B, or C, or any combination of any two or more of A, B, or C. For example, "at least one of A, B, and C" includes A alone; or B alone; or C alone; or A and B; or A and C; or B and C; or all of A, B, and C.

The term "adjacent" means proximate to but not in direct contact with.

The term "includes" is synonymous with "comprises".

As used herein, the terms "parallel" or "substantially parallel" mean a relative angle as between two objects (if extended to theoretical intersection), such as elongated objects and including reference lines, that is from 0° to 5°, or from 0° to 3°, or from 0° to 2°, or from 0° to 1°, or from 0° to 0.5°, or from 0° to 0.25°, or from 0° to 0.1°, inclusive of the recited values.

As used herein, the terms "perpendicular" or "substantially perpendicular" mean a relative angle as between two objects at their real or theoretical intersection is from 85° to 90°, or from 87° to 90°, or from 88° to 90°, or from 89° to 90°, or from 89.5° to 90°, or from 89.75° to 90°, or from 89.9° to 90°, inclusive of the recited values.

The discussion of the disclosure may describe certain features as being "particularly" or "preferably" within certain limitations (e.g., "preferably", "more preferably", or "even more preferably", within certain limitations). It is to be understood that the disclosure is not limited to these particular or preferred limitations but encompasses the entire scope of the disclosure.

FIG. 1 shows a cradle 10 according to an embodiment or aspect of the disclosure for receiving a fall arrest device. The cradle 10 has a first contact surface ring 11 and a second contact surface ring 12. The contact surface rings 11, 12 are attached together by means of links 13.

In some non-limiting embodiments or aspects, the second contact surface ring 12 has a larger diameter than the first contact surface ring 11. Both rings 11, 12 have a toroidal shape (e.g., a circular cross-section), which means that the rings 11, 12 roll smoothly along an arcuate path of a specific radius. The specific radius of the arcuate path is determined by the relative diameters of the rings 11, 12.

In some non-limiting embodiments or aspects, the contact surface rings 11, 12 are the only portions of the cradle 10 which contact the surface on which the cradle 10 rests. Thus, the cradle 10 is shaped to inhibit rolling along any other paths than the arcuate path.

In some non-limiting embodiments or aspects, the first contact surface ring 11 defines a first aperture 11*a* in the cradle (shown in FIG. 1) and the second contact surface ring 12 defines a second aperture 12*a* in the cradle.

In some non-limiting embodiments or aspects, the rings 11, 12 have engagement formations 14. The engagement formations can be configured to receive complementary engagement formations on a fall arrest device, such that there is a snap-fit engagement between the device and the cradle.

Figure 2:
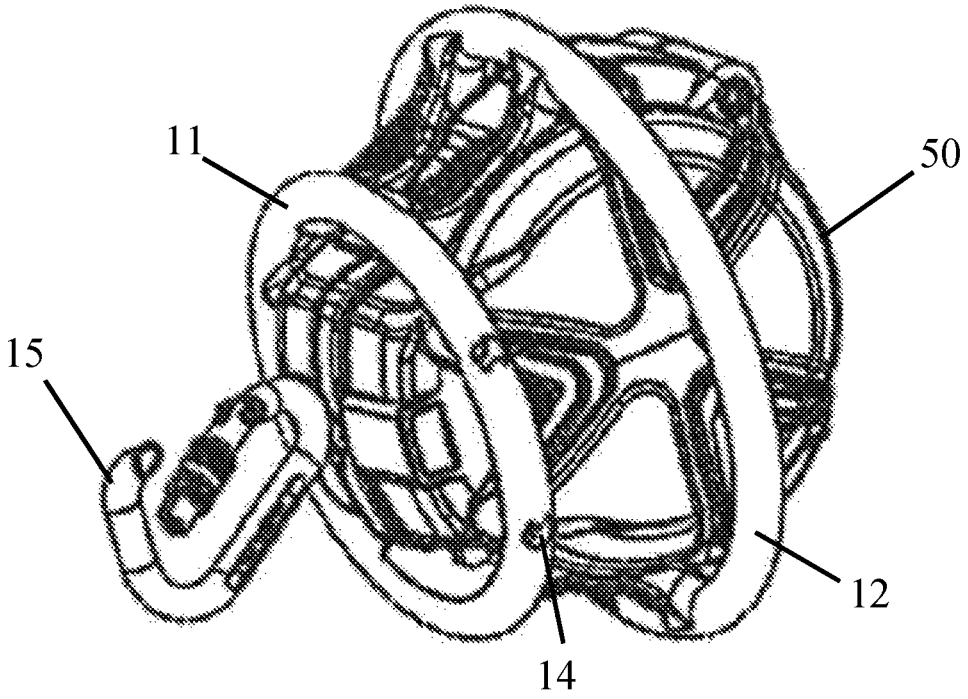
FIG. 2 is a side perspective view of an SRL received in the cradle of FIG. 1.

Additionally or alternatively, one or more of the engagement formations 14 may be fixing apertures configured to receive a mechanical fixing to secure the cradle relative to the fall arrest device (see FIG. 2).

FIG. 2 shows the cradle 10 of FIG. 1 with a self-retracting lifeline (SRL) device 50 received therein. The SRL 50 may for example be of the type described in WO2010/094921.

In order to arrive at the arrangement in FIG. 2, the end of the SRL 50 attached to a connector 15 for connecting the device 50 to a structural anchor is inserted through aperture 12*a* of the cradle 10 until the connector 15 projects through the first aperture 11*a*. The complementary engagement formations on the housing of the device (not shown) and on the cradle 14 then attach in a snap-fit engagement, thereby securing the cradle 10 with respect to the device 50.

In some non-limiting embodiments or aspects, bolts or other mechanical fixings may be received in the engagement formations 14.

Figure 3:
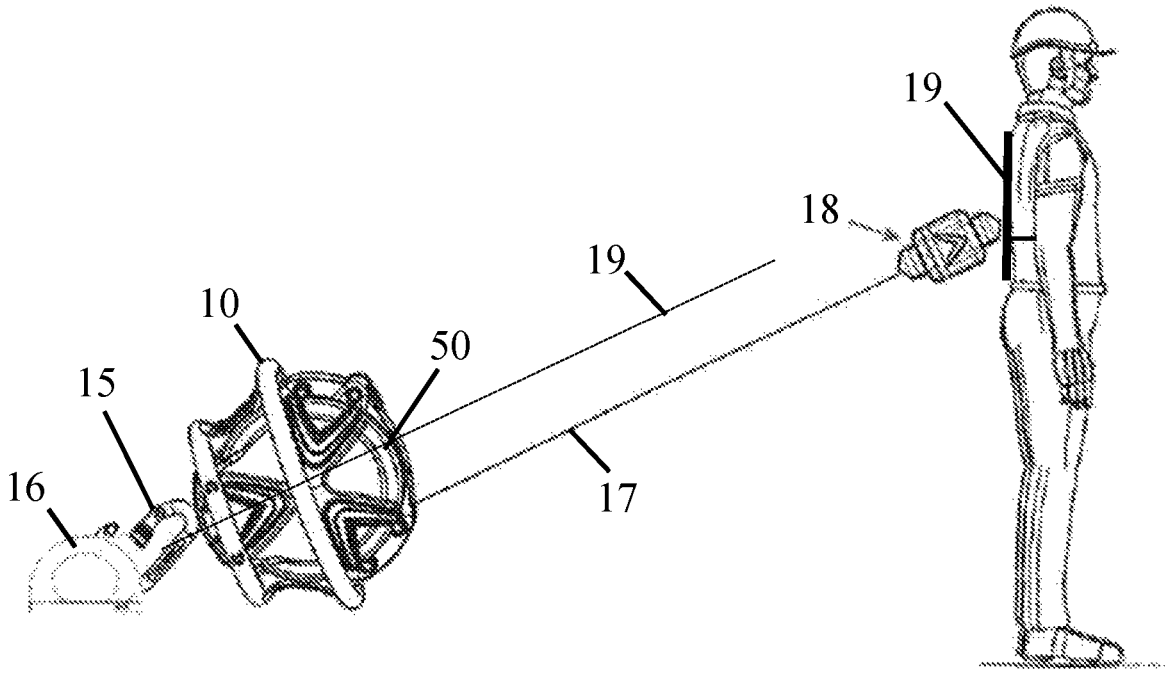
FIG. 3 is a side view of the SRL and cradle shown in FIG. 2 used in a fall arrest system.

FIG. 3 shows the apparatus of FIG. 2 as part of a fall arrest system. It is important to note that the figures are schematic illustrations which are not drawn to scale.

In FIG. 3, the SRL 50 is secured in the cradle 10 as in FIG. 2 and a connector (e.g., a carabiner) 15 has been attached through the connection point on the device 50 and an structural anchor 16 disposed at floor level. The lifeline 17 wound onto the drum of the SRL 50 extends through aperture 12*a* of the cradle and is connected to an energy absorber device 18. The energy absorber device 18 may be of any known type.

In some non-limiting embodiments or aspects, the energy absorber device 18 is secured to a user's harness 19 in accordance with the relevant safety regulations.

In use, when the user moves around the surface 25, the cradle 10 can roll smoothly in an arcuate path about the structural anchor 16 on the first and second surface contact rings 11, 12. This prevents the SRL device 50 scraping along the surface 25 and becoming damaged. The safety labels attached to the housing of the SRL device 50 (not shown) are also clearly visible through the cradle 10, in accordance with safety regulations.

In some non-limiting embodiments or aspects, the SRL device 50 rotates about a rolling axis 19 orientated in the same direction as the lifeline 17. This is advantageous as it ensures that the lifeline 17 does not get tangled as the SRL device 50 and cradle 10 roll. The rolling axis 19 is inclined to the surface 25 upon which the cradle 10 is supported.

Figure 4:
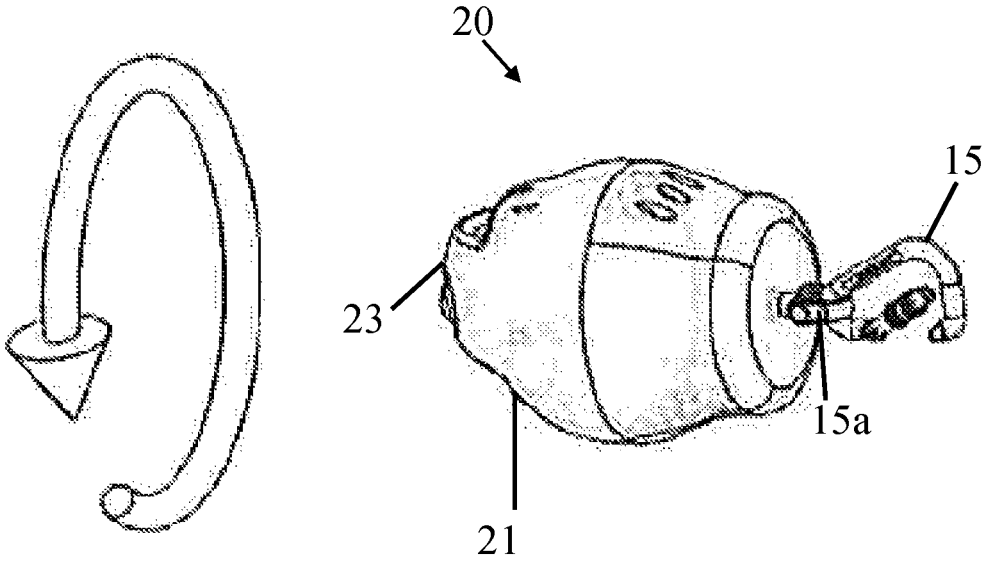
FIG. 4 is a side view of a rollable case according to the principles of the present disclosure.

FIG. 4 shows a case 20 for receiving a fall arrest device therein in accordance with the present disclosure. The case 20 may be one within which an SRL housing is fitted, or the case 20 may provide the actual case of the SRL. This means that a case 20 can be retro-fitted to an existing SRL or an SRL can be manufactured having a case 20 as the device housing. Such an SRL could be used overhead or in rolling mode (e.g., mounted proximate the floor), as described.

In some non-limiting embodiments or aspects, the case 20 has a housing 21 which has a circular profile. At least a portion of the housing 21 is substantially curved, part conical or part spherical. The housing 21 is shaped such that, in use, it rolls in the direction shown by the arrow in FIG. 4 along an arcuate path.

In some non-limiting embodiments or aspects, the size and shape of the housing 21 (for example the degree of curvature) determines the specific radius of the arcuate path about which the case 20 can roll. The shape of the housing 21 inhibits rolling of the case 20 along any other paths or rolling axes.

In some non-limiting embodiments or aspects, a first end of the housing 21 has a connection point 15*a*. The connection point 15*a* (e.g., a shackle or eyelet) may be bolted or otherwise attached to the housing 21. A connector 15 is secured through the connection point 15*a* to attach the case 20 to a structural anchor 16 (see FIG. 5). The connection point 15*a* and the connector 15 may be provided separately to the case 20.

In some non-limiting embodiments or aspects, the housing 21 also has an aperture 23 on the second end opposite to the connection point 15*a*. The aperture 23 is sized to receive a lifeline of the SRL device 50 therethrough.

Figure 5:
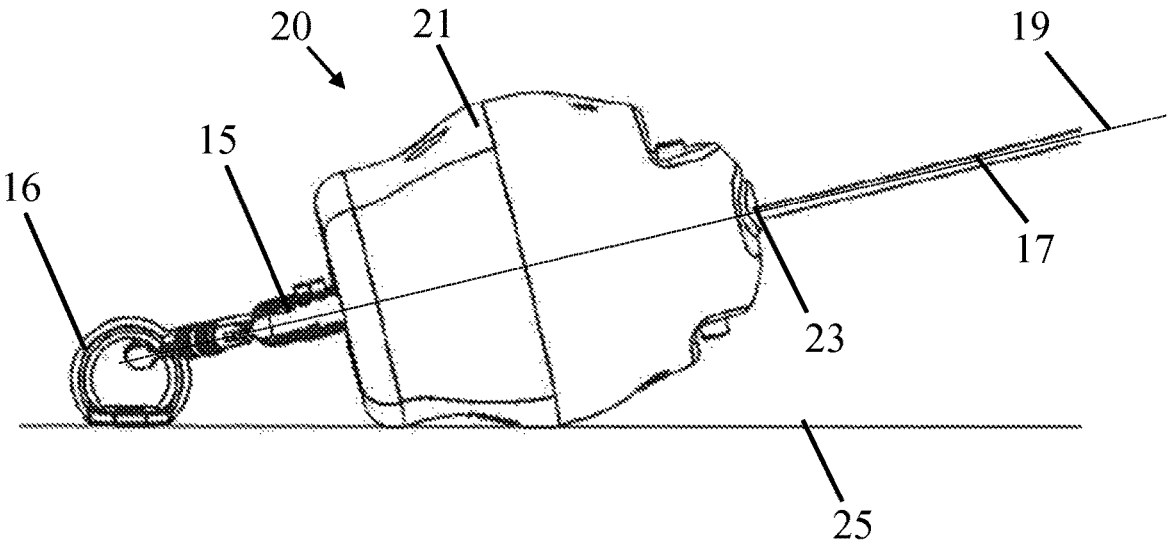
FIG. 5 is a detailed view of the rollable case of FIG. 4 shown as part of a fall arrest system.

FIG. 5 shows the case 20 of FIG. 4 as part of a fall arrest system. The system has an SRL device 50 having an outer case 20. The housing 21 of the case 20 is formed into two halves which are then slotted together around the SRL device 50, or around an inner portion of the SRL device 50.

In some non-limiting embodiments or aspects, a carabiner (or connector) 15 attaches the SRL device 50 to an anchor point 16 on the surface 25 which is at floor level for a user. A lifeline 17 which is wound onto a drum of the SRL device 50 extends out of aperture 23 in the housing 21 where it can be attached to an energy absorber device and/or a user's harness (as in FIG. 3). The housing 21 is shaped so that the case and the device received therein roll smoothly in an arcuate path about the structural anchor 16.

As in FIG. 3, the SRL 50 rolls about a rolling axis 19 orientated in the same direction as the lifeline 17, which is inclined to the surface 25.

Figure 6:
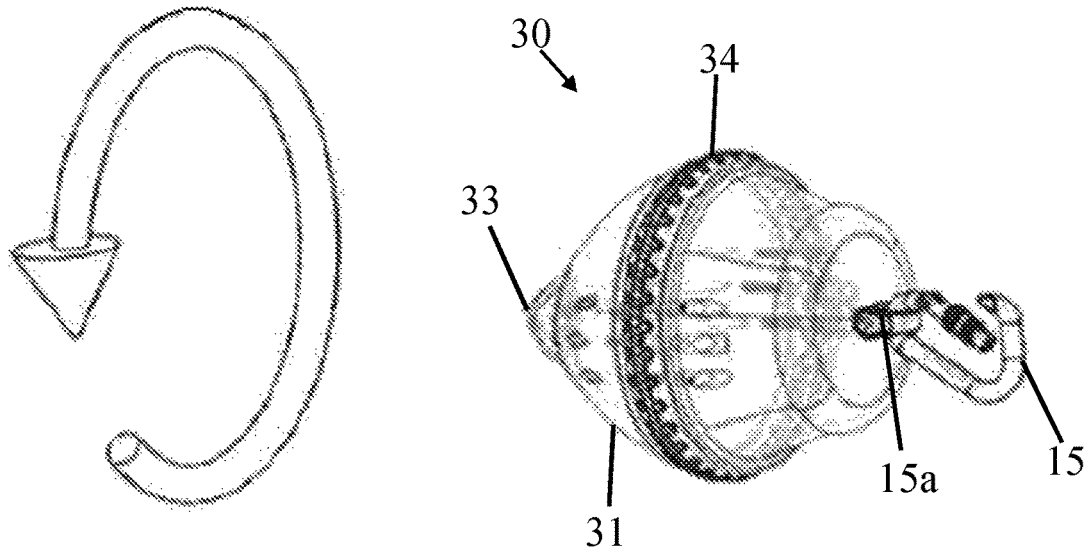
FIG. 6 is a perspective view of a rollable case according to further principles of the present disclosure.

FIG. 6 shows another example of a case 30 according to the present disclosure. The case 30 has a housing 31 with a circular profile, similar to the housing 21 in FIG. 4. The aperture 33 and connection point 15*a* perform the same function as in FIG. 4.

However, in FIG. 6 the case 30 has a tire 34 secured around the largest diameter of the housing 31. The tire 34 is made of a synthetic rubber material which is shock-absorbing and the tire 34 has a plurality of indentations and/or projections which improve the grip between the case 30 and a surface on which it rests.

In use, the shape of the housing 31 and the tire 34 ensures that the case 30 rolls smoothly in the direction shown by the arrow in FIG. 6 along an arcuate path.

Figure 7:
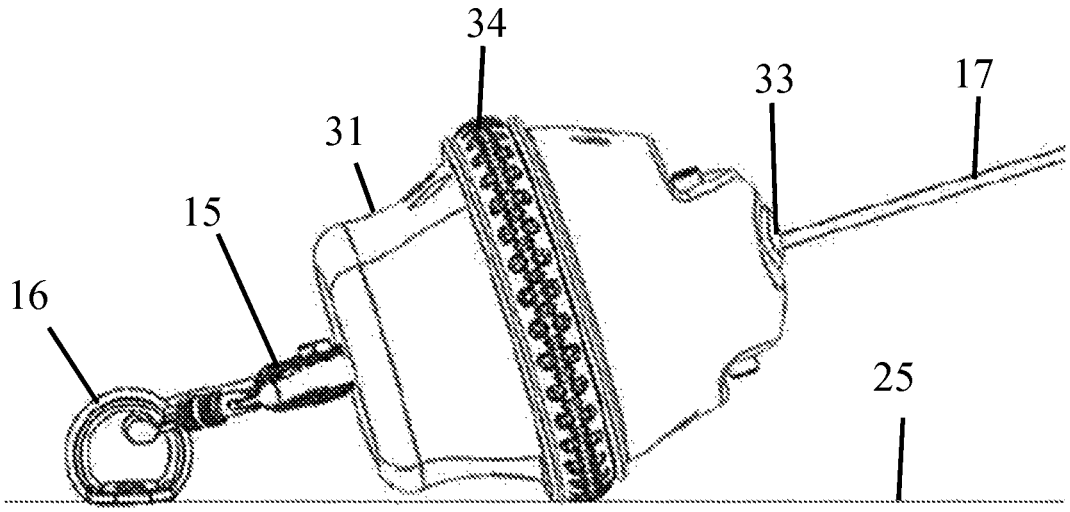
FIG. 7 is a detailed view of the rollable case of FIG. 6 shown as part of a fall arrest system.

FIG. 7 shows the case 30 of FIG. 6 as part of a fall arrest system. This is essentially the same as shown in FIG. 5 but with the addition of the tire 34, thus common features between these two figures have been numbered accordingly.

Although the disclosure has been described in detail for the purpose of illustration based on what are currently considered to be the most practical and preferred embodiments or aspects, it is to be understood that such detail is solely for that purpose and that the disclosure is not limited to the disclosed embodiments or aspects, but, on the contrary, is intended to cover modifications and equivalent arrangements that are within the spirit and scope of the appended claims. For example, it is to be understood that the present disclosure contemplates that, to the extent possible, one or more features of any embodiment or aspect can be combined with one or more features of any other embodiment or aspect.

What is claimed is:

1. A cradle for a fall arrest device, the cradle comprising:

a first contact surface ring defining a first aperture and having a first diameter;

a second contact surface ring defining a second aperture and having a second diameter different than the first diameter; and one or more links connecting the first contact surface ring to the second contact surface ring, wherein the cradle is configured to roll around an arcuate path of a specific radius about a rolling axis extending through the first aperture and the second aperture.

2. The cradle of claim 1, wherein the rolling axis is inclined at an angle relative to a surface supporting the cradle.

3. The cradle of claim 1, further comprising one or more engagement formations on at least one of the first contact surface ring and the second contact surface ring, each of the one or more engagement formations configured for connecting to complementary engagement formations on a fall arrest device.

4. The cradle of claim 3, wherein at least one of the one or more engagement formations is configured for snap-fit engagement with the fall arrest device.

5. The cradle of claim 4, wherein at least one of the one or more engagement formations is a fixing aperture configured to receive a mechanical fastener for securing the cradle relative to the fall arrest device.

6. The cradle of claim 1, wherein the cradle comprises the fall arrest device.

7. The cradle of claim 6, wherein the fall arrest device is a self-retracting lanyard.

8. The cradle of claim 6, wherein the fall arrest device rotates about the rolling axis with the cradle.

9. The cradle of claim 6, wherein the rolling axis is orientated in a same direction as a safety line of the fall arrest device.

* * * * *